US008633825B2

(12) United States Patent
Fuller et al.

(10) Patent No.: US 8,633,825 B2
(45) **Date of Patent: *Jan. 21, 2014**

(54) EXPANSION TANK WITH A PREDICTIVE SENSOR

(75) Inventors: James Fuller, Zionsville, IN (US); David M. Stedham, Reno, NV (US)

(73) Assignee: Wessels Company, Greenwood, IN (US)

( * ) Notice: Subject to any disclaimer, the term of this patent is extended or adjusted under 35 U.S.C. 154(b) by 775 days.

This patent is subject to a terminal disclaimer.

(21) Appl. No.: 12/009,469

(22) Filed: Jan. 18, 2008

(65) Prior Publication Data

US 2008/0179333 A1 Jul. 31, 2008

Related U.S. Application Data

(63) Continuation-in-part of application No. 11/699,172, filed on Jan. 29, 2007, which is a continuation-in-part of application No. 11/500,219, filed on Aug. 8, 2006, now Pat. No. 7,775,260.

(51) Int. Cl.
*G08B 21/00* (2006.01)

(52) U.S. Cl.
USPC ..... 340/654; 340/584

(58) Field of Classification Search
USPC ..... 340/686, 679, 612–626, 654, 584, 286; 220/721, 771; 235/492
See application file for complete search history.

(56) References Cited

U.S. PATENT DOCUMENTS

| | | | | |
|---|---|---|---|---|
| 3,760,396 | A * | 9/1973 | Haselton | 340/984 |
| 3,762,959 | A * | 10/1973 | McCoy | 429/3 |
| 2004/0191093 | A1* | 9/2004 | Weigl | 417/413.1 |
| 2005/0270041 | A1* | 12/2005 | Lieder et al. | 324/663 |
| 2006/0028997 | A1* | 2/2006 | McFarland | 370/252 |
| 2006/0131314 | A1* | 6/2006 | Lombari et al. | 220/721 |
| 2006/0152380 | A1* | 7/2006 | Anderson et al. | 340/679 |
| 2008/0145279 | A1* | 6/2008 | Pendergrass | 422/83 |

* cited by examiner

*Primary Examiner* — Shirley Lu
(74) *Attorney, Agent, or Firm* — Olson & Cepuritis, Ltd.

(57) ABSTRACT

An expansion tank which comprises a tank having a predetermined volume capacity; a flexible diaphragm in the tank, partitioning tank volume into a liquid-containing portion for holding liquid and a gas-containing portion for holding a gas under a pressure that defines a normal pressurized gas volume when the liquid-containing portion holds a predetermined liquid volume; and a proximity sensor suspended in the gas-containing portion of the tank and adapted to energize an alarm signal when volume of the gas-containing portion is reduced a predetermined amount as indicated by proximity of the diaphragm.

13 Claims, 7 Drawing Sheets

EXPANSION TANK WITH A PREDICTIVE SENSOR

CROSS-REFERENCE TO RELATED APPLICATION

This application is a continuation-in-part of U.S. Ser. No. 11/699,172, filed on Jan. 29, 2007, which, in turn, is a continuation-in-part of U.S. Ser. No. 11/500,219 filed on Aug. 8, 2006, now U.S. Pat. No. 7,775,260, and incorporated herein by reference.

FIELD OF INVENTION

This invention relates to expansion tanks in hydronic systems and the like. More particularly, one aspect of this invention relates to predictive sensors in installed expansion tanks that are part of hydronic systems and the like.

BACKGROUND OF INVENTION

Hydronics refers to the use of water as a heat transfer medium in heating and cooling systems. Hydronic systems are commonly utilized in heating, ventilating and air conditioner (HVAC) applications, hydropneumatic water well and potable water pressure booster systems, fire protection systems, municipal and commercial systems requiring water hammer shock and/or water pressure surge protection, domestic potable water heating systems, fluid storage systems, and the like. Typical HVAC hydronic systems include a circulating heat transfer medium loop, associated valves, a radiator, a pump, and a boiler or chiller to implement the desired heat transfer. A water loop hydronic system also must include at least one expansion tank to accommodate a varying volume of the heat transfer liquid, such as water, inasmuch as the liquid volume contracts and expands as it cools and heats. The expansion tanks utilize a flexible diaphragm pressurized with compressed gas such as air to accommodate the variations in liquid volume by further gas expansion or compression, and help control pressure in the hydronic system.

Expansion tanks usually include a diaphragm that defines a liquid portion to hold the excess liquid and a compressed gas portion for controlling over-all system pressure. When the diaphragm is overextended due to an excessive system pressure or a gas leak from the tank, the diaphragm can burst, necessitating a costly system shut-down for repair. It would be advantageous to detect not only system failures such as a rupture of the diaphragm but also a condition wherein the diaphragm has been overly extended and is likely to burst unless remedial steps, e.g., reduction in system pressure by draining, are timely taken.

Existing, installed such systems currently have no provision for detecting an abnormal or catastrophic failure of the internal diaphragm or bladder that separates the stored liquid from a captive compressed gas portion in the tank.

Accordingly, it is an object of the present invention to provide a device that can be mounted not only in new installations but also in an existing expansion tank for monitoring extension of the diaphragm within the tank.

The term "diaphragm" as used herein and in the appended claims denotes a flexible, deformable web or membrane that spans the tank and is secured to the sidewall of the tank (FIG. 8) or a flexible bladder suspended in the tank (FIG. 2) and adapted to hold a liquid. In either case, the web or membrane, as well as the bladder, partitions the tank interior into two compartments or portions—a closed, gas-containing portion or chamber for containment of a gas under pressure and a liquid-containing portion for the holding of a portion of the liquid that expands from the system.

It is a further object of this invention to provide an expansion tank system and method of use which includes an expansion detector that does not damage the diaphragm in the expansion tank.

It is also an object to provide an expansion tank having a sensor element which is able to detect potential diaphragm failure modes, i.e. tank flooding and/or over-extension of a tank diaphragm.

It is yet another object to provide an expansion tank alarm system module that can be readily installed or replaced through a tank coupling.

These and other objects and advantages of the apparatus and method aspects of the present invention will be apparent to those skilled in the expansion tank art.

SUMMARY OF THE INVENTION

Expansion tanks embodying the present invention are capable of detecting a potential failure condition in an expansion tank due to an abnormal deflection of the tank's diaphragm in a hydronic system, loss of counterbalancing gas pressure in the tank, and the like.

In particular, an expansion tank of the present invention comprises a tank having a predetermined volume capacity and an expandable, flexible diaphragm in the tank. The diaphragm partitions the tank volume into a liquid-containing portion for holding a liquid and a gas-containing portion for holding a gas under a pressure that defines a normal pressurized gas volume when the liquid-containing portion of the tank holds a predetermined liquid volume. A proximity sensor is situated in the gas containing portion thereof and is adapted to emit or energize an alarm signal when the gas containing portion is reduced as a result of excessive diaphragm displacement detected by the proximity sensor.

A wide variety of proximity sensors, capable of detecting position of the diaphragm can be utilized. Illustrative are the capacitive proximity sensors such as a dielectric type capacitive proximity sensor, a conductive type capacitive proximity sensor, and the like, mechanical proximity sensors such as strain gages and the like, electromechanical proximity sensors, and the like.

As stated hereinabove, the diaphragm can be an elastomeric or flexible deformable web or membrane that partitions the tank interior, or an elastomeric or flexible bladder mounted in the tank that defines the liquid-containing portion of the tank.

A method aspect of the present invention is directed to monitoring the size of an expanding or contracting gas volume by noting the position of a flexible diaphragm situated in an expansion tank and comprises the steps of detecting by means of a proximity sensor the presence of an expansion tank diaphragm at a predetermined location in the gas-containing portion of the tank and generating an alarm in response to a signal received from the proximity sensor.

The proximity sensor can be mounted in several ways, depending upon the type of proximity sensor utilized. In the case of the capacitive proximity sensors, these sensors can extend into the gas-containing portion of the tank through an appropriate coupling, e.g., a through coupling and the like, or these sensors can detect the presence of the diaphragm through a sight glass and the like provided in the tank wall. In the case of a mechanical or electromechanical proximity sensor, at least a portion of the sensor extends into the gas-containing portion of the tank. The mechanical or electromechanical proximity sensors are activated by physical contact with the diaphragm.

The proximity sensors contemplated by the present invention are also capable of detecting a flooding condition within the tank, that is, the condition when the diaphragm has burst and liquid in the expansion tank has encroached into the gas-containing portion of the tank.

Expansion tanks equipped with a diaphragm proximity sensor according to the present invention are also suitable for use in municipal water and sewage handling systems, power wash systems, reverse osmosis systems, fuel handling systems, fire protection systems, and the like where fluctuations in system pressure of a liquid must be accommodated.

For some installations, e.g., retrofit installations as well as new installations, the proximity sensor is suspended in the gas containing portion of the tank by a cable, chain, rod and the like expedient, and is spaced a predetermined distance away from the diaphragm. Spacing between the proximity sensor and the diaphragm can be adjusted after installation, if desired.

DESCRIPTION OF PREFERRED EMBODIMENTS

Figure 1:
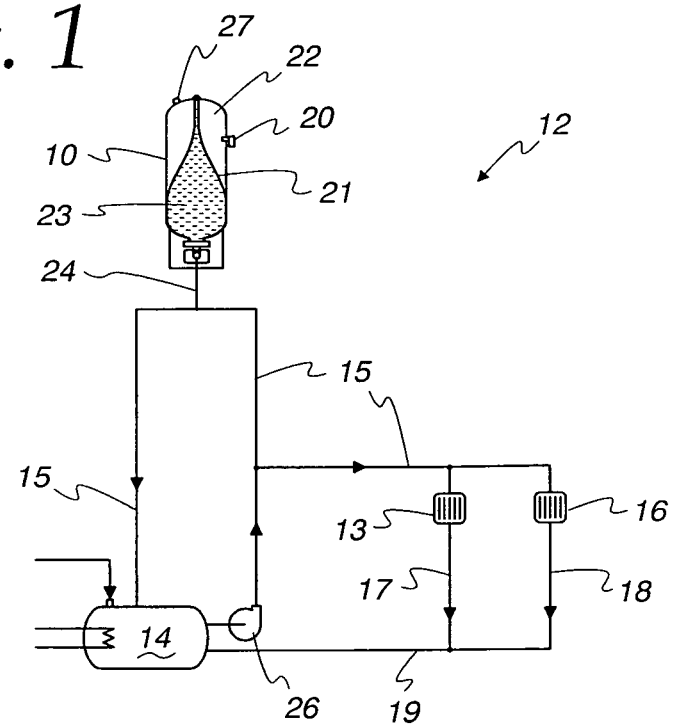
FIG. 1 is a schematic illustration of a closed-loop hydronics system that utilizes an expansion tank embodying the present invention.

The invention described herein is, of course, susceptible of embodiment in many forms. Shown in the drawings and described hereinbelow in detail are preferred embodiments of the present invention. It is to be understood, however, that the present disclosure is an exemplification of the principles of this invention but does not limit this invention to the illustrated embodiments.

Figure 2:
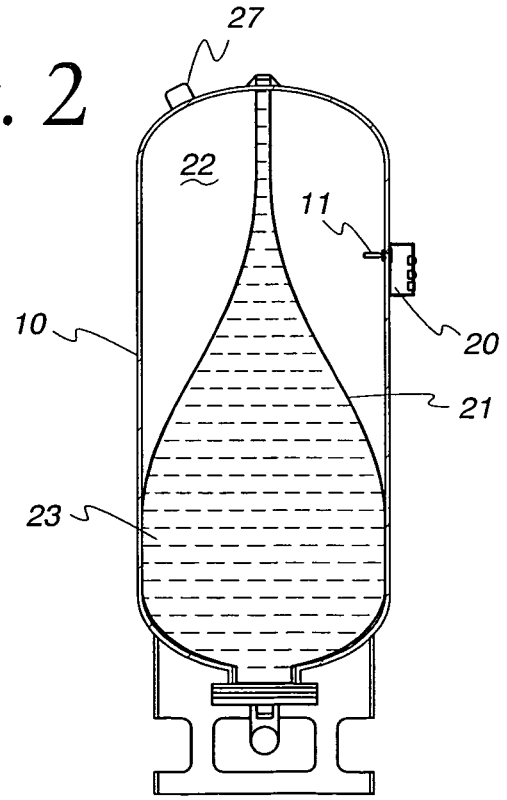
FIG. 2 is an enlarged elevational view of the expansion tank shown in FIG. 1.

Referring to FIGS. 1 and 2, a closed loop heating system 12 includes expansion tank 10 equipped with proximity sensor 11 and alarm module 20 mounted to tank 10. Proximity sensor 11 preferably is a dielectric type capacitive proximity sensor such as Model C1ALLAN1-P, commercially available from Stedham Electronics Corporation, Reno, Nev. 89502, U.S.A. Boiler 14 supplies hot water which is circulated through radiators 13 and 16 by pump 26 via lines 15, 17, 18 and 19. Line 24 is in fluid flow communication with line 15 as well as with bladder-type diaphragm 21 in expansion tank 20. Excess system water 23 is held within bladder-type diaphragm 21. System pressure, typically about 12 to about 30 pounds per square inch gage (psig) is maintained by reason of pressurized gas within gas-containing portion 22. Tank 10 is also equipped with air charging valve 27 for adjusting air pressure in the gas-containing portion 22.

Figure 3:
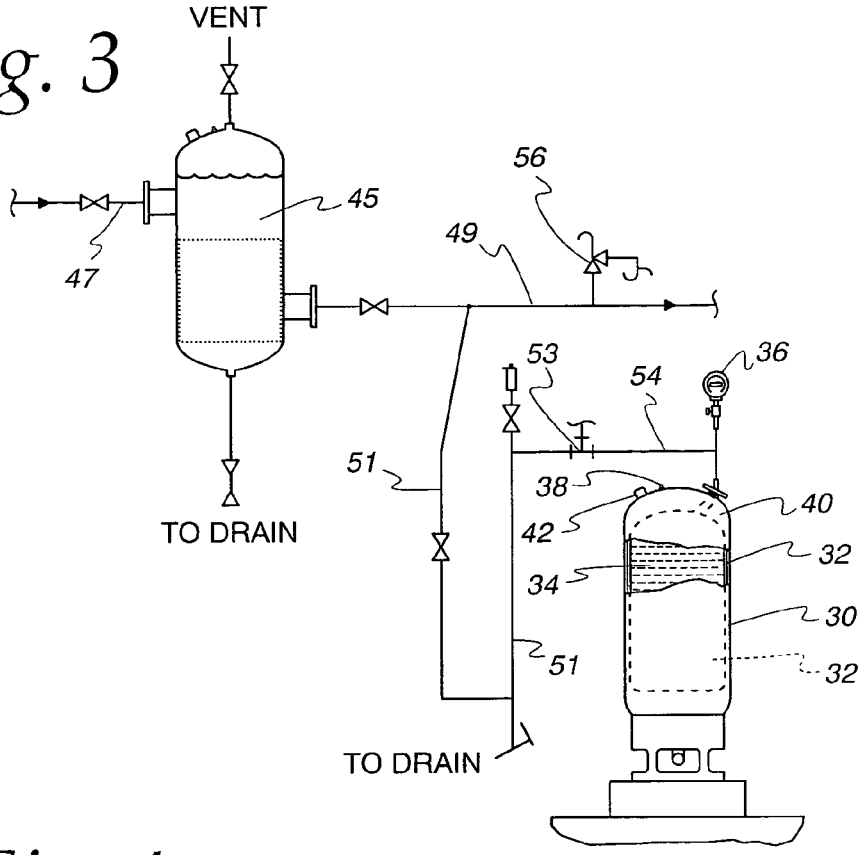
FIG. 3 is a schematic illustration of an air separation and expansion tank detail of a hydronics system, the expansion tank being provided with a bladder type diaphragm.

FIG. 3 illustrates a hydronics installation. Floor mounted, vertical expansion tank 30 is equipped with suspended bladder 32 that holds excess system water 34. Pressure gage 36 monitors system water pressure. Air charging valve 38 is provided on tank 30 for pressurization of gas-containing portion 40 of tank 30. Proximity sensor 42 is mounted to tank 30 and monitors conditions within the gas-containing portion 40. If bladder 32 expands beyond a predetermined limit due to an abnormal increase in system pressure or an air leak in gas-containing portion 40, proximity sensor 42 detects such an expansion and emits a signal that energizes an appropriate alarm so that system water pressure can be relieved before excessive stress or bursting pressure is reached within bladder 32. If overexpansion of bladder 32 is due to an air leak from gas-containing portion 40, additional air pressure can be supplied through air charging valve 38.

Air separator 45 is provided in feed line 47 that communicates via water line 49 with the input or suction side of a pump (not shown). Expansion tank 30 and its bladder 32 are, in turn, in fluid flow communication with water line 49 via line 51. Tee connection 53 is provided in line 54 to facilitate connection with another, parallel expansion tank if desired. System pressure relief valve 56 is also provided in communication with water line 49.

Figure 4:
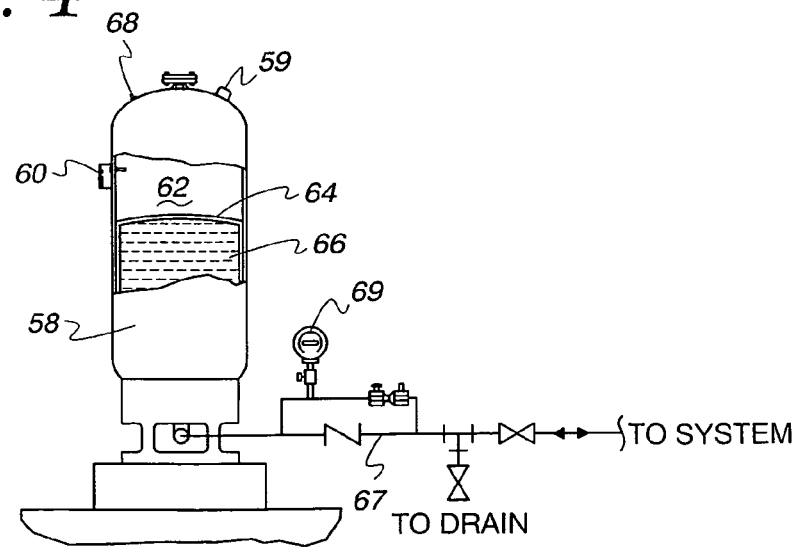
FIG. 4 is a schematic illustration of a hydropneumatic expansion tank embodying the present invention and utilizing a diaphragm in the form of an elastomeric, flexible web that partitions the tank volume into a gas-containing portion and a liquid containing portion.

FIG. 4 illustrates a typical installation of a vertical, floor mounted expansion tank 58 that is provided with proximity sensor 60 mounted to tank 58 in the region that defines gas-containing portion 62 within tank 58. Flexible membrane 64 partitions tank 58 into a gas-containing portion 62 and liquid containing portion 66. Tank 58 also has an air charging valve 68 and inspection port 59.

Liquid-containing portion 66 is in fluid flow communication with a water system via line 67. Pressure gage 69 in line 67 monitors system water pressure.

Figure 5:
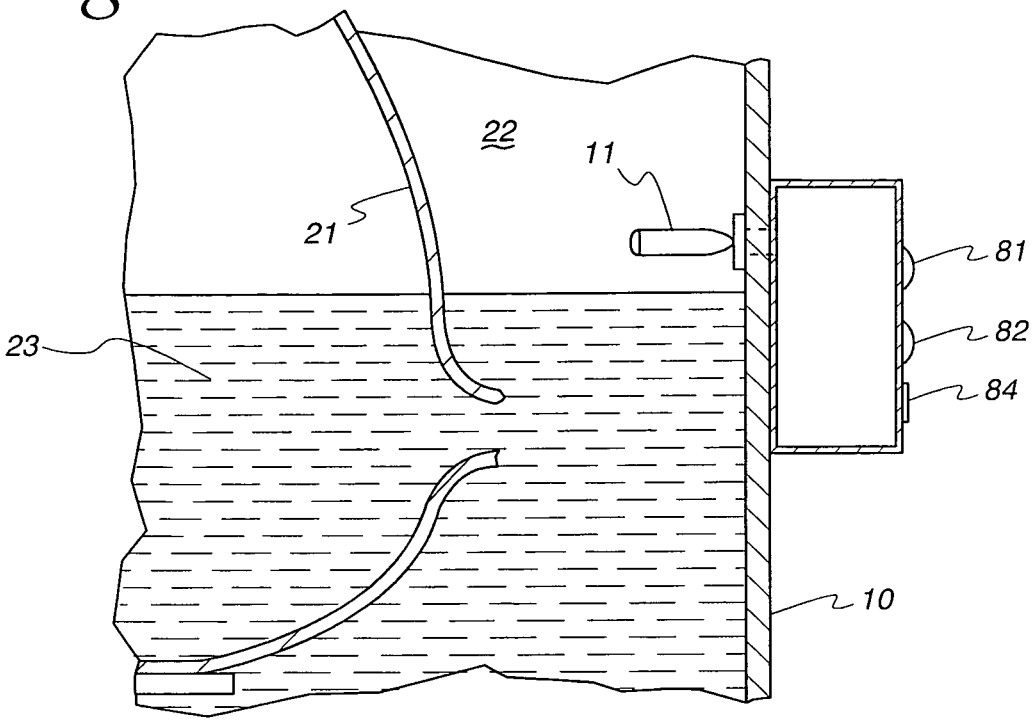
FIG. 5 is a schematic illustration of an electromechanical proximity sensor mounted in the wall of an expansion tank at flooding conditions.

FIG. 5 illustrates a flooding condition in expansion tank 10. Bladder-type diaphragm 21 has burst and water held within the liquid-containing portion 23 has entered gas-containing portion 22. Proximity sensor 11 mounted to tank detects the approaching water level, emits an alarm signal that, in turn, energizes alarm module 20 equipped with audible alarm 81 as well as with visual indicator light 82 and on/off/reset button 84. Remote alarm capabilities can be incorporated as well, if desired.

Figure 6:
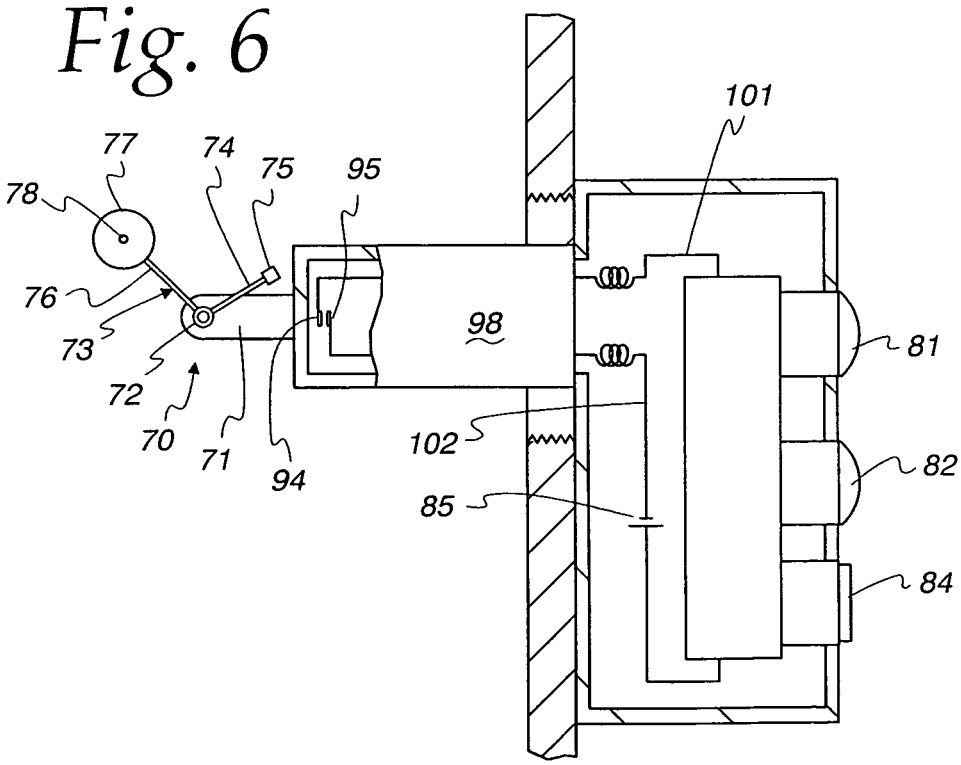
FIG. 6 is a schematic illustration of an electromechanical proximity sensor mounted in the wall of an expansion tank.

FIG. 6 illustrates electromechanical proximity sensor 70 equipped with alarm module 90 mounted in the wall of an expansion tank. Proximity sensor 70 extends into the gas-containing portion of the tank and alarm module 90 associated with sensor 70 is situated outside the expansion tank.

Proximity sensor 70 includes a float 77 mounted at the distal end of arm 76 which forms an integral, substantially L-shaped piece 73 with arm 74 that carries a magnet 75 at the distal end thereof. The L-shaped piece 73 is pivotably mounted at 72 to bar 71 supported by housing 98. When float 77 is moved upwardly either by an expanding bladder or the buoyant force exerted on float 77 by a rising water level, magnet 75 approaches and closes contact points 94 and 96 in housing 98, thereby closing the alarm circuit in alarm module 90. This alarm circuit includes, in addition to contact points 94 and 96, leads 101 and 102, a power source such as battery 85, audible alarm 81, visual alarm 82, and on/off/reset button 84.

Figure 7:
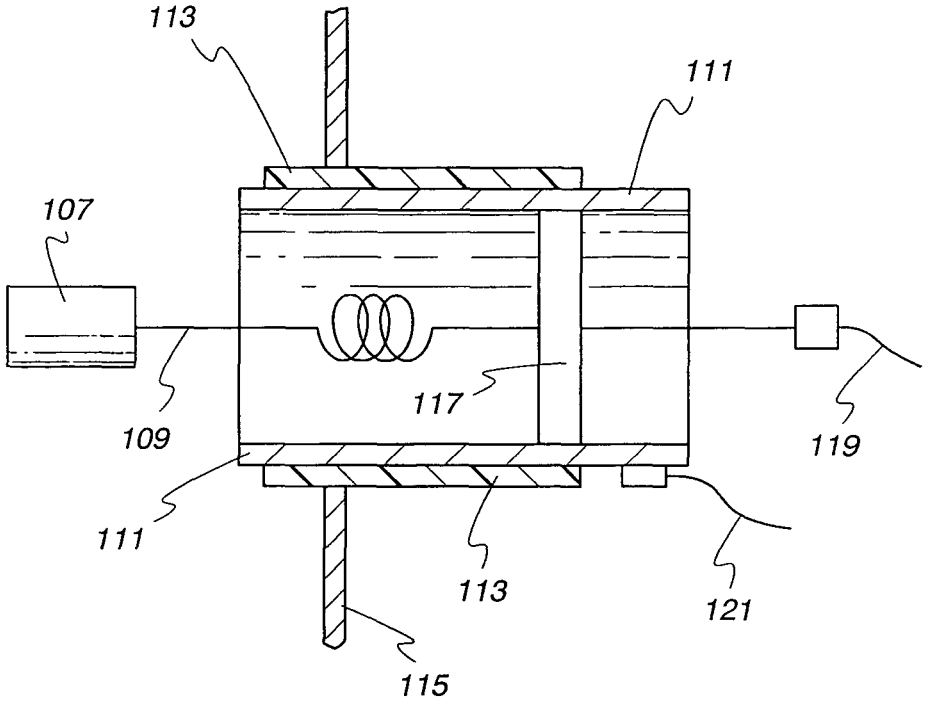
FIG. 7 is a schematic illustration of another type of electromechanical proximity sensor.

FIG. 7 depicts another proximity sensor suitable for use in practicing the present invention.

In this particular embodiment float 107 is affixed to the distal end of a wire spring 109 mounted in a conductive sleeve 111 but electrically isolated therefrom. Leads 119 and 121 are connected, respectively, to wire spring 109 and conductive sleeve 111 and to the same alarm module as that shown in FIG. 6. Wire spring 109 is held in place inside conductive sleeve 111 by epoxy disc 117. The alarm circuit is closed and an alarm signal emitted when float 120 is urged upwardly either by an expanding diaphragm or a rising water level and wire spring 109 contacts conductive sleeve 111.

Figure 8:
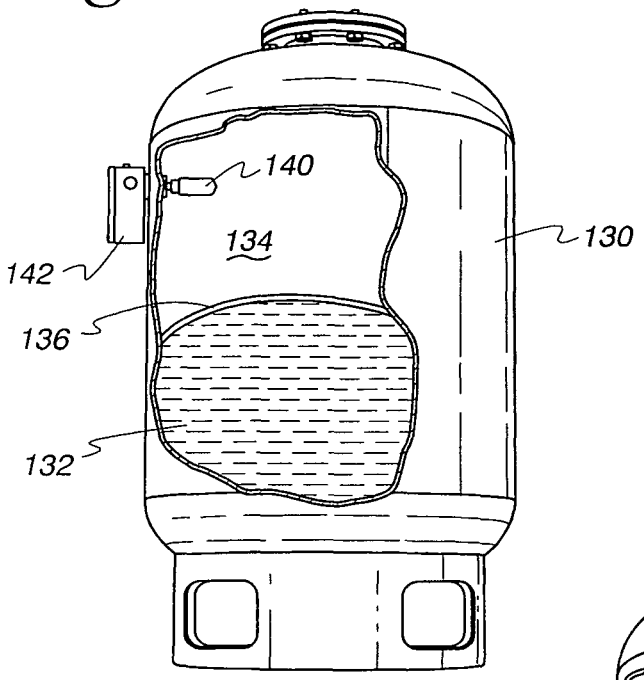
FIG. 8 is a schematic illustration of an expansion tank embodying the present invention and under normal operating conditions.
Figure 9:
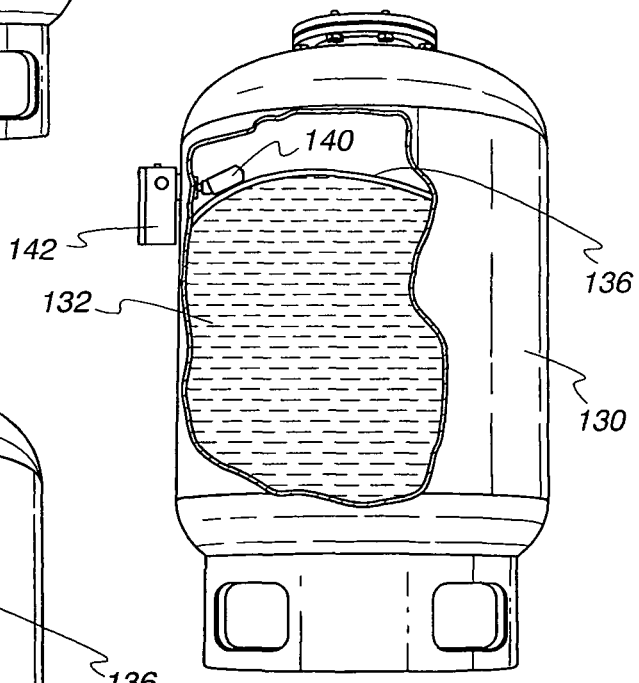
FIG. 9 is a schematic illustration of an expansion tank embodying the present invention and under abnormal, excessive system pressure condition.
Figure 10:
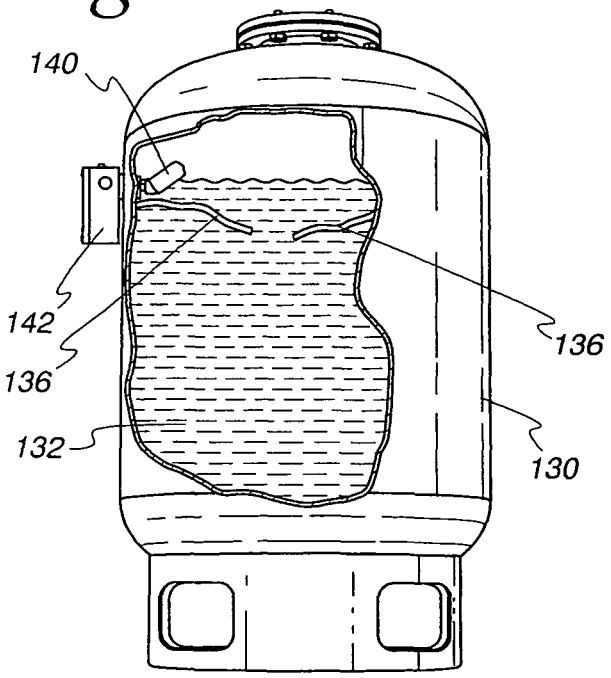
FIG. 10 is a schematic illustration of an expansion tank embodying the present invention and showing a ruptured diaphragm as well as a flooded condition.

FIGS. 8, 9 and 10 illustrate the position of the diaphragm in an expansion tank under various conditions. In FIG. 8 expansion tank 130 is shown under normal operating conditions, the liquid 132 held in tank 130 occupying about 40 percent of tank volume, pressurized gas 134 occupying about 60 percent of tank volume and being separated from liquid 132 by diaphragm 136. In this particular example the system water pressure is in the range of about 12 to about 30 psig and is counterbalanced by pressurized gas 134. Proximity sensor 140 is mounted in the wall of tank 130. Alarm module 142 associated with sensor 140 is on the outside of the tank 130.

When the system water pressure rises (FIG. 9), more of liquid 132 occupies the tank volume and diaphragm 136 becomes deformed or distended, shifting proximity sensor 140 upwardly and energizing the alarm. Similarly, when diaphragm 136 has burst, rising water level in tank 130 maintains proximity sensor 140 in an upwardly position as shown in FIG. 10.

Figure 11:
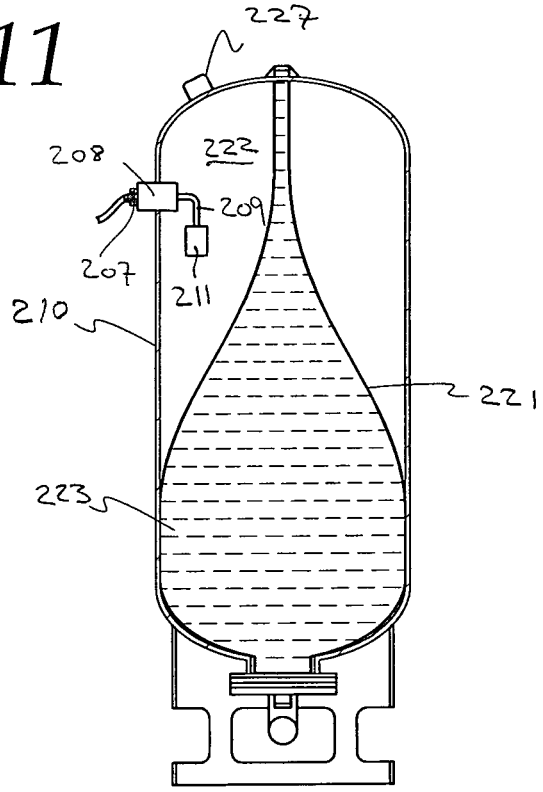
FIG. 11 is a schematic illustration of an expansion tank retrofitted with a suspended, dielectric type capacitive proximity sensor mounted in the tank wall by means of an existing tank coupling.

Referring to FIG. 11, expansion tank 210 is equipped with proximity sensor 211 mounted to expansion tank 210 through tank coupling 208 and suspended in gas-containing portion 222. Proximity sensor 211 is spaced from bladder-type diaphragm 221 and positioned by a flexible support line such as cable 209 and the like. Tank coupling 208 is provided with a gas sealing plug 207 that sealingly secures cable 209 and any sensor positioning device, if included, to the tank.

Figure 12:
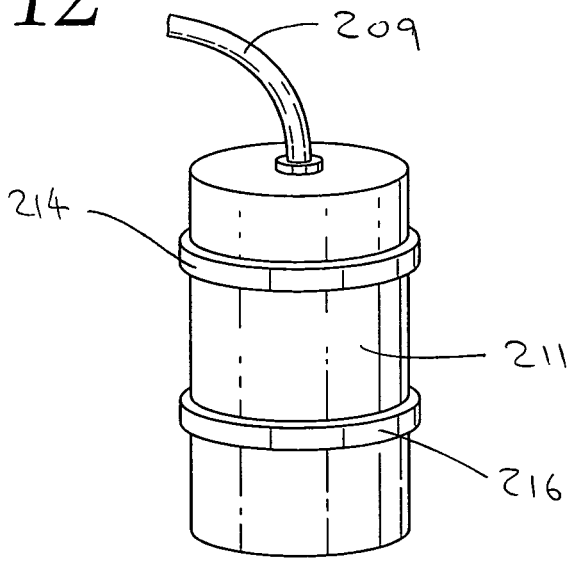
FIG. 12 is an enlarged perspective view of a preferred configuration for a suspended capacitive proximity sensor.

A preferred configuration for a capacitive proximity sensor is shown is shown in FIG. 12. Capacitive proximity sensor 211, suspended from cable 209, is provided with annular spacer rings 214, 216 of sufficient thickness to prevent proximity sensor 211 from approaching or contacting a wall portion of tank 210 and providing a false indication or energizing a false alarm. Preferably annular spacer rings 214, 216 are made of a non-conductive or inert material such as plastic, neoprene rubber, silicone rubber, and the like. Proximity sensor 211 is shown as having a cylindrical shape; however, the shape of the proximity sensor can vary.

Figure 13:
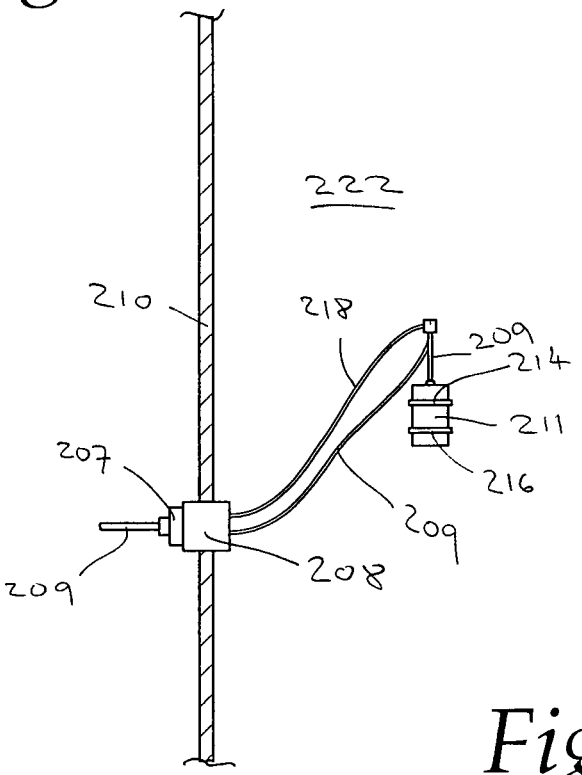
FIG. 13 is an enlarged, fragmentary view showing a positionable, capacitive proximity sensor in the tank suspended from a pliant rod that extends into the compressed gas portion of the tank.

Referring to FIG. 13, capacitive proximity sensor 211, surrounded by annular spacer rings 214, 216 is suspended in expansion tank 210 from a pliant rod 218 which is shaped to provide a desired spacing from and above the diaphragm. Pliant rod 218 can be a relatively stiff but bendable wire, a deformable plastic, e.g., polyethylene, rod, and the like.

Figure 14:
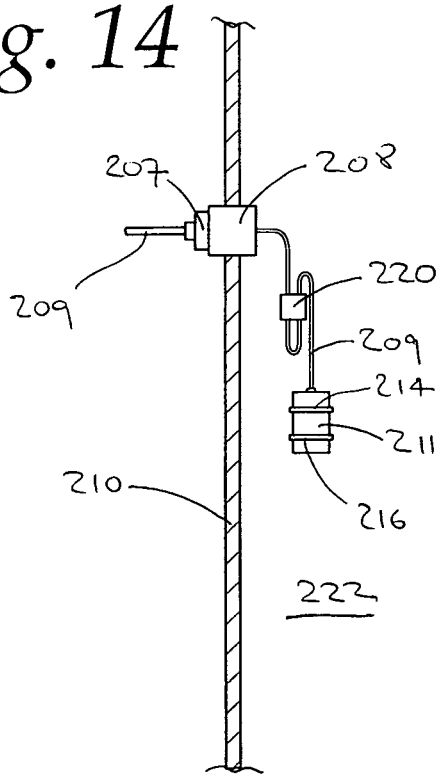
FIG. 14 is an enlarged, fragmentary view showing another embodiment or a positionable, capacitive proximity sensor suspended in the tank.

FIG. 14 shows an alternative embodiment for positioning capacitive proximity sensor 211. In particular, cable 209 is threaded through an electric wire clip 220 that foreshortens that portion of cable 209 which extends into the gas-containing portion of tank 210 through tank coupling 208.

The sensor mounting arrangements illustrated in FIGS. 13 and 14 permit the positioning, as well as repositioning, of sensor 211 at a desired distance from the diaphragm that separates the gas-containing portion of the tank from the liquid-containing portion of the tank.

While a suspended proximity sensor can be utilized in a new expansion tank installation and provide the adjustability-after-installation feature, a suspended proximity sensor is particularly well suited for retrofitting prior installations of vertical as well as horizontal expansion tanks. Such tanks, already in service, usually have an inspection port or a through coupling in the tank sidewall or in the dome of the tank. The inspection port or coupling may not be situated at the desired height for a fixed installation of the sensor, however. A suspended or suspendable proximity sensor, on the other hand, can be readily adapted for installation in such cases, and can be positioned at an optimum spacing from the expandable diaphragm in the tank.

Under normal operating conditions in a hydronics system, the liquid volume in the expansion tank is about 40 percent of total tank volume and the pressurized gas or air volume is about 60 percent of total tank volume. An alarm condition occurs when the diaphragm is distended to near its maximum tensile or burst strength. The latter, of course, is dependent on the material of construction and thickness of the diaphragm. Suitable expansion tank diaphragm materials are butyl rubber, natural rubber, nitrile rubber, and the like.

Preferably, the proximity sensor is positioned at or in the expansion tank so that an alarm signal is emitted when the gas-containing portion of the tank has been reduced by at least about 40 percent of normal value.

The alarm signal can be processed in a variety of ways. As described hereinabove, the alarm signal can be utilized to energize an audible alarm or a visual alarm. The alarm signal can also be transmitted to a remote site having a centrally located monitor or data logger that can receive alarm signals from more than one expansion tank in a hydronics system or systems. The choice of a particular expansion tank monitoring arrangement depends largely on the size of the involved hydronic system or systems involved.

The foregoing specification and the drawings are illustrative of the present invention but are not to be taken as limiting. Still other variants and arrangements of parts are possible and will readily present themselves to those skilled in hydronic systems art.

We claim:

1. An expansion tank which comprises: a tank having a predetermined volume capacity; a flexible diaphragm in the tank, partitioning tank volume into a liquid-containing portion for holding liquid and a closed gas-containing portion for holding a gas under a pressure that defines a normal pressurized gas volume when the liquid-containing portion holds a predetermined liquid volume; and a proximity sensor suspended in the gas-containing portion of the tank spaced from the diaphragm, and energize an alarm signal when the proximity sensor detects diaphragm displacement.

2. The expansion tank in accordance with claim 1 wherein the proximity sensor is a dielectric capacitive proximity sensor.

3. The expansion tank in accordance with claim 1 wherein the proximity sensor is a conductive capacitive proximity sensor.

4. The expansion tank in accordance with claim 1 wherein the proximity sensor is positionable in the gas-containing portion of the tank.

5. The expansion tank in accordance with claim 1 wherein the proximity sensor is suspended in the gas-containing portion of the tank from a pliant rod.

6. The expansion tank in accordance with claim 1 wherein the diaphragm together with a portion of tank wall defines the liquid-containing portion of the tank.

7. The expansion tank in accordance with claim 1 wherein the diaphragm is a bladder that alone defines the liquid-containing portion of the tank.

8. The expansion tank in accordance with claim 1 wherein the proximity sensor energizes an alarm signal when volume of the gas-containing portion is reduced by at least 40 percent of normal pressurized gas volume.

9. The expansion tank in accordance with claim 1 wherein the proximity sensor has annular spacer rings that prevent contact between the proximity sensor and a wall portion of the expansion tank.

10. A method of determining degree of expansion of a flexible diaphragm in an expansion tank wherein said diaphragm together with a wall portion of said tank define a closed, gas-containing compartment for holding a gas under pressure and a liquid-containing compartment for storing a liquid, the method comprising:

suspending a proximity sensor in the closed, gas-containing compartment spaced from the diaphragm;

positioning the proximity sensor for detection of the diaphragm in the gas-containing compartment; and energizing an alarm in response to a detection signal emitted by the proximity sensor.

11. A hydronics system which includes an expansion tank having an expandable diaphragm therewithin and partitioning tank volume into a liquid-containing portion and a closed gas-containing portion holding a gas under pressure, and a diaphragm proximity sensor suspended in the gas-containing portion of the tank spaced from the diaphragm and energize an alarm signal when presence of the expandable diaphragm is detected by the proximity sensor.

12. The hydronics system in accordance with claim 11 wherein the diaphragm is a flexible bladder diaphragm.

13. The hydronics system in accordance with claim 11 wherein the diaphragm is a membrane fixed to periphery of the tank.

* * * * *